US009133588B2

(12) United States Patent
Stroyer

(10) Patent No.: US 9,133,588 B2
(45) Date of Patent: Sep. 15, 2015

(54) BOARDWALK, DECK, AND PLATFORM SYSTEM

(76) Inventor: Benjamin G. Stroyer, Rochester, NY (US)

( * ) Notice: Subject to any disclaimer, the term of this patent is extended or adjusted under 35 U.S.C. 154(b) by 2849 days.

(21) Appl. No.: 11/490,795

(22) Filed: Jul. 21, 2006

(65) Prior Publication Data

US 2007/0028533 A1 Feb. 8, 2007

Related U.S. Application Data

(60) Provisional application No. 60/701,666, filed on Jul. 22, 2005.

(51) Int. Cl.

| | |
|---|---|
| ***E02B 3/06*** | (2006.01) |
| ***E04C 3/04*** | (2006.01) |
| ***E01D 2/00*** | (2006.01) |
| ***E01D 15/133*** | (2006.01) |
| ***E01D 19/00*** | (2006.01) |
| ***E01D 19/02*** | (2006.01) |

(52) U.S. Cl.

CPC ..... *E01D 2/00* (2013.01); *E01D 15/133* (2013.01); *E01D 19/005* (2013.01); *E01D 19/02* (2013.01); *E02B 3/068* (2013.01); *E04C 2003/0439* (2013.01); *E04C 2003/0465* (2013.01)

(58) Field of Classification Search

USPC ..... 52/650.3, 170, 177, 712, 713, 714, 702, 52/745.21, 289, 263, 157, 161, 295, 126.1, 52/126.5, 126.6, 705, 709

See application file for complete search history.

(56) References Cited

U.S. PATENT DOCUMENTS

| | | | | |
|---|---|---|---|---|
| 3,676,965 | A * | 7/1972 | Deike | 52/98 |
| 3,999,346 | A | 12/1976 | Fetherston | |
| 4,078,515 | A | 3/1978 | Svirklys | |
| 4,145,976 | A | 3/1979 | Svirklys | |
| 4,778,142 | A * | 10/1988 | Roba | 248/545 |
| 4,833,846 | A * | 5/1989 | McFeetors et al. | 52/154 |
| 5,048,448 | A * | 9/1991 | Yoder | 114/263 |
| 5,553,427 | A | 9/1996 | Andres | |
| 5,555,694 | A * | 9/1996 | Commins | 52/702 |
| 5,617,689 | A | 4/1997 | Beane | |
| 5,623,803 | A * | 4/1997 | Willis | 52/650.3 |
| 5,735,097 | A | 4/1998 | Cheyne | |
| 5,901,396 | A | 5/1999 | Ahlskog | |
| 5,906,077 | A | 5/1999 | Andiarena | |
| 5,950,337 | A * | 9/1999 | Lehrman | 38/103 |
| 5,950,377 | A | 9/1999 | Yoder | |
| 6,112,479 | A | 9/2000 | Andres | |
| 6,170,212 | B1 | 1/2001 | Suchyna | |
| 6,233,886 | B1 * | 5/2001 | Andres | 52/177 |

(Continued)

OTHER PUBLICATIONS

International Search Report (mailed Sep. 20, 2007) for International Application No. PCT/US06/28328 (10 pages).

*Primary Examiner* — Jessica Laux

(74) *Attorney, Agent, or Firm* — Barclay Damon, LLP

(57) ABSTRACT

The invention provides a system, method, and components for assembling and disassembling boardwalks, decks, and platforms. The invention has a number of extruded and interlocking components. It is installed by driving piles, preferably helical piles, into a ground surface. The invention provides a comprehensive set of assembly members, including and not limited to brackets that attach to the piles, headers, joists, cross braces, decking, and decking fasteners for holding the decking in place. In particular, a multiple-way adjustable bracket connects the piles to the rest of the structure.

26 Claims, 11 Drawing Sheets

(56) References Cited

U.S. PATENT DOCUMENTS

| | | | | |
|---|---|---|---|---|
| 6,301,842 | B1 | 10/2001 | Chaney | |
| 6,314,699 | B1 | 11/2001 | West | |
| 6,324,796 | B1 | 12/2001 | Heath | |
| 6,594,961 | B2 * | 7/2003 | Leines | 52/177 |
| 6,742,311 | B2 | 6/2004 | Fortier | |
| 6,814,525 | B1 | 11/2004 | Whitsett | |
| 6,817,157 | B2 * | 11/2004 | Bourque | 52/712 |
| 7,334,372 | B2 * | 2/2008 | Evans et al. | 52/289 |
| 2001/0025465 | A1 * | 10/2001 | Osfolk | 52/650.3 |
| 2004/0050009 | A1 | 3/2004 | Fuhr | |
| 2004/0050010 | A1 | 3/2004 | Fortier | |
| 2004/0216250 | A1 | 11/2004 | Dumlao | |

* cited by examiner

BOARDWALK, DECK, AND PLATFORM SYSTEM

CROSS-REFERENCE TO RELATED APPLICATIONS

This application claims priority from U.S. Provisional Patent Application Ser. No. 60/701,666, filed Jul. 22, 2005.

FIELD OF THE INVENTION

This invention relates to modular decking systems.

BACKGROUND OF THE INVENTION

It is a significant conventional construction project to install a deck or a similar structure such as a dock, boardwalk, or platform, whether it is a permanent installation or a temporary one. The equipment needed to install the conventional deck can be very disruptive to the ground surface affecting the appearance of a lawn or a park or affecting the ecosystem in wetlands. Also, the skill and care needed to precisely place and fasten together the components of the deck is time consuming and costly—especially when equipment must be submerged to reach a stable underground surface. Further adding to the cost and skill required, the deck is often custom built on site.

A modular deck system, such as the one described in U.S. Patent Application, Publication No. 2005/0025465 by Osfolk, allows the deck to be assembled in smaller portions. Pre-manufactured deck modules have the advantage of requiring less on-site assembly. However, such conventional modular or pre-manufactured decks require precise placing of piers or piles and either require significant fastening with screws or bolts, or are not significantly sturdy. Further, pre-manufactured decks tend to be quite heavy and cumbersome with regard to the shipping, handling, and placement of the decks. Even further, the length of time it takes to assemble conventional modules causes delays in the advancement of the equipment along the modules.

Conventional decking systems tend to have relatively weak connections between a wooden joist and a header. Such systems utilize joist hangers that are fastened to the side of a header and to the end of the joist. Such connections to the end of the joist lack significant shear strength and the connection may be a weak point in the system.

Therefore, a modular decking system that has a simple assembly and a minimal impact on the ground surface while being sturdy enough to support foot traffic and light vehicles is desired. Further, a decking system with structurally superior joints over conventional systems in critical areas is desired.

SUMMARY OF THE INVENTION

The invention comprises, in one form thereof, a system, method and components for assembling and disassembling boardwalks, decks, bridges, platforms and similar structures ("deck" will be generally used to denote a boardwalk, deck, bridge, platform, or similar structure hereinafter). The invention has a number of extruded and interlocking components. It is installed by driving piles, preferably helical piles, into a ground surface. The invention provides a comprehensive set of assembly members, including and not limited to brackets that attach to the piles, headers, joists, cross braces, decking, and decking fasteners for holding the decking in place. The components of the invention are useful together with each other and also with conventional structural members. In particular, a multiple-way adjustable bracket connects the piles to the rest of the structure. Piles often encounter subsurface impediments and cannot be set at their precise desired locations. The pile bracket adjusts for off-set piles.

More particularly, the invention includes a relatively lightweight modular decking system, comprising a plurality of piles (which may comprise aluminum) having a helical portion configured to be driven into a ground surface; a pile bracket that engages a top end of each of the piles; a plurality of headers, each attached to two of the pile brackets; a plurality of joists each being attached to two of the headers; and a plurality of deck planks that are attached to a top portion of the joists or decking connectors. The pile brackets are adjustable wherein each of the pile brackets are rotatable about a center axis of the pile and translatable along the center axis of the pile. Further, each of the pile brackets include a saddle assembly that is translatable along a slot in the pile bracket in a direction that is substantially perpendicular to the center axis of the pile. The saddle assembly is rotatable about a fastener and is capable of being leveled, such as by a plurality of set screws or a partial ball joint. The deck planks may be attached to the joists by an injection molded connector strip having a plurality of spacer posts separating said deck planks. The connector strip may further include a plurality of clips provided in pairs, wherein the deck planks each include a pair of tabs, and wherein each pair of clips is configured for mating with the pair of tabs on one of the deck planks. The header may include a plurality of joist holders, and the joists may be placed in said joist holders to attach the joists to the headers.

In another form, the invention includes a method for installing a modular deck. The method comprises the steps of driving a first set of helical piles and a second set of helical piles (which may be aluminum) into a ground surface, wherein the piles each have an adjustable pile bracket on a top end of the pile; providing a plurality of headers having a plurality of header brackets; affixing one of the headers to each of the first and second sets of piles via the pile brackets such that the header brackets of the header affixed to the first set of piles are aligned with the header brackets of header affixed to the second set of piles; inserting a joist into each of the aligned header brackets; and placing a plurality of deck planks on the joists. The method may further comprise the steps of driving a third set of helical piles into the ground surface, wherein the piles of the third set each have an adjustable pile bracket on a top end of the piles; affixing a header to the third set of piles via the pile brackets such that the header brackets of the header attached to the third set of piles are aligned with the header brackets of the header attached to the second set of piles; inserting an additional joist into each of the aligned header brackets of the headers attached to the second and third sets of piles; and placing a plurality of additional deck planks on the additional joists. The method may further include installing additional modules as needed. In a temporary application of the decking system, the method includes the further step of disassembling the deck planks from the joists, the joists from the headers, and the headers from the piles, and then removing the piles from the ground surface. A further step of reinforcing the joists with cross-braces may also be included. The step of placing the deck planks may comprise the steps of connecting a plurality of connector strips to one or more of the joists, the connector strips having a plurality of pairs of clips; and, for each of the deck planks, snapping a pair of tabs integral with the deck plank into one of the pairs of clips.

In another form, the invention includes an adjustable decking bracket having multiple degrees of freedom. The bracket comprises a base plate defining a slot; a collar affixed to a bottom surface of the base plate, which is rotatable about a center axis of the collar; a saddle assembly that has a protuberance connected to the base plate by a fastener through the slot; and a vertical adjustment fastener engaging the base plate and a support structure. The saddle assembly may include a plurality of set screws or a hub, such as a partial ball joint, in a saddle base for leveling the saddle assembly relative to the base plate. Further, the saddle assembly is translatable along the slot of the base plate and rotatable about the fastener connecting the protuberance to the slot of the base plate.

In another form, the invention includes an end cap for a plurality of decking planks. The end cap comprises a tube providing a chase-way; a lens-receiving portion on a side of the tube; a connection portion on a bottom surface of the tube, the connection portion being configured to be attached to a frame element. The connection portion may be configured to snap into a groove in a joist. The end cap may include a plurality of lamps within said tube, and it may form an ADA-compliant curb.

In another form, the invention includes a helical pile comprising an aluminum shaft and an inclined plane extending from a portion of the shaft in a helical shape. The inclined plane may be made of aluminum and may be welded to or integral with the shaft. The helical pile may also include a second inclined plane extending from a second portion of the shaft, extensions to add length, or both.

In another form, the invention includes a header for a modular decking system. The header comprises a header beam having a first side and a second side; and a plurality of joist holders welded to or integral with the first side of said header beam. The header beam may be made of extruded metal or structural steel and the header beam and the joist holders may be made of aluminum. Alternatively, the header may be cast or molded material. A second plurality of joist holders may be welded to or integral with the second side of the header beam. The joist holders define a pair of aligned notches for engaging a fastener through an end of a joist to guide the placement of the joist.

In another form, the invention includes a connector strip for affixing deck planks to a joist. The connector strip comprises a base configured for engaging a joist; a plurality of spacer posts projecting upward from the base; and a plurality of pairs of clips, wherein each pair of clips is configured for engaging a pair of tabs associated with a deck plank. The connector strip may further include a first end with a male connector and a second end with a female connector such that the male connector connects to a female connector of another connector strip. The base may be configured for sliding into a groove in an extruded joist. The connector strip may be configured such that no fasteners are required to connect the connector strip to the joist or to connect the deck plank to the connector strip. The connector strip may also be connected to conventional lumber.

It is an advantage of the invention that the boardwalk, deck or platform provides a support for pile installation equipment. As one section of the platform is assembled, the installation machine may advance to the end of the platform to install piles for the next section. The decking system according to the present invention may be rapidly installed and the equipment may advance without stalling for significant periods of time to wait for a new module to be installed. The invention may also be used as a bridge.

The structures made in accordance with the invention may be installed in protected environments, such as wetlands, nature preserves, swamps, marshes and beaches. The installation provides minimal disruption to the environment. The structures may also be installed as decks for home use. In another embodiment the structures may be installed temporarily at a location that needs a hardstand to support a number of people, such as a stage for a band in a park. After the event is over, the structure may be disassembled and removed.

A further advantage of the invention is that the header comprises integral or pre-welded joist holders that have significantly higher shear strength than conventional joist hangers. Thus the header provides an improved long-range structural integrity over conventional systems, which may be compromised at this junction.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
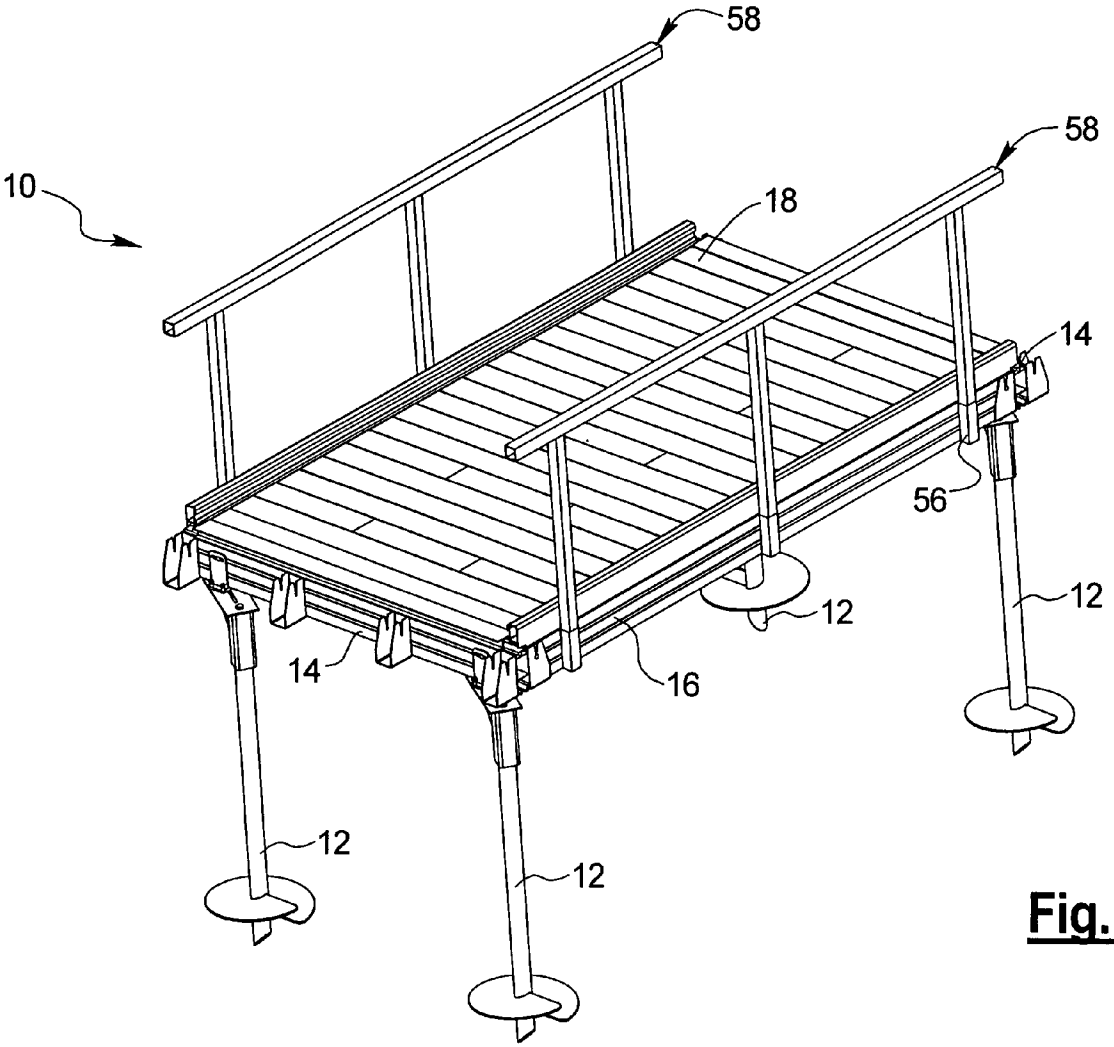
FIG. 1 is an isometric view of a deck module according to the present invention.

Referring to FIG. 1, there is shown the modular deck of the present invention. The deck module 10 includes a number of helical piles 12, a pair of headers 14, joists 16, and a number of deck planks 18.

Figure 2D:
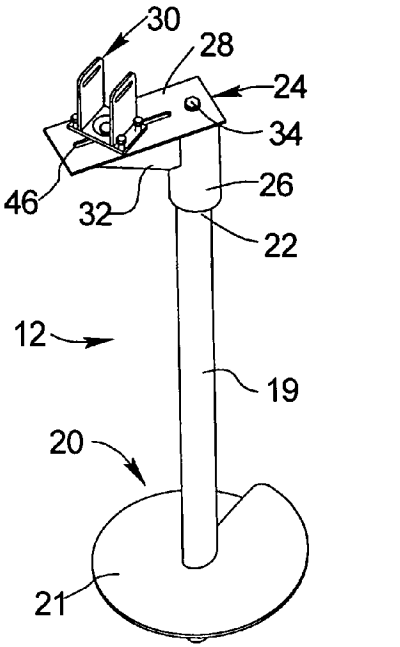
FIGS. 2A-2D are views of the helical pile and pile bracket of FIG. 1.
Figure 2C:
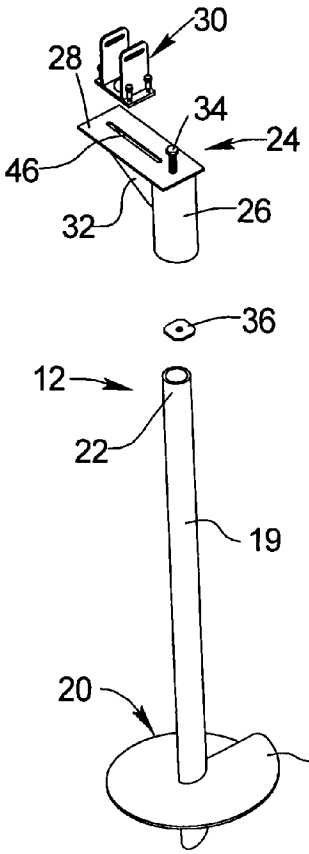
Figure 2B:
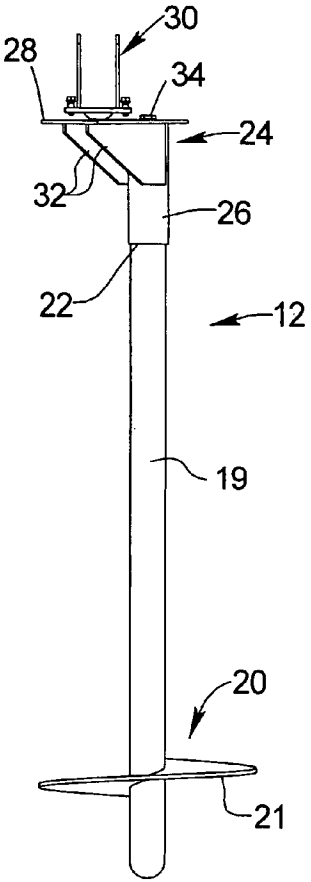
Figure 2A:
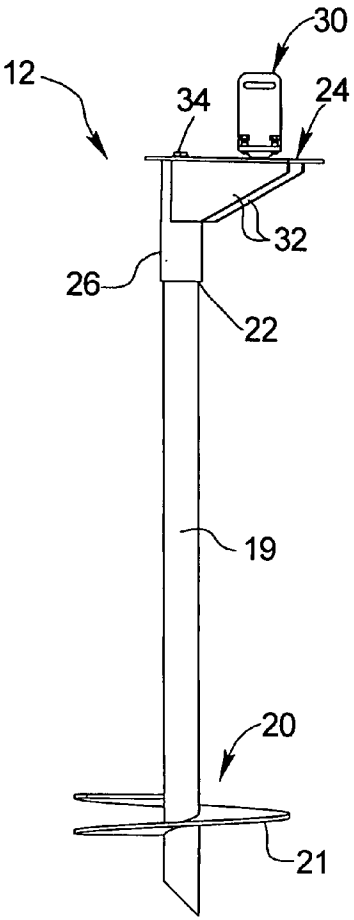

FIG. 1 shows the deck module 10 as having four piles 12; however, more or less piles 12 may be used as warranted by the application. For example, additional piles 12 may be required for additional support of the headers 14 or the joists 16. The helical pile 12 is best shown in FIGS. 2A-2D and includes a shaft 19 and a helical portion 20 for driving the pile 12 into a ground surface and a top end 22 that engages a pile bracket 24. The helical portion 20 includes an inclined plane 21 extending from the shaft 19 in a helical shape. The shaft 19 is cylindrical, as shown in FIG. 2C; however, the shaft 19 may alternatively be substantially any shape, such as a rectangular tube. The pile 12 may include multiple helical portions 20 each having an inclined plane 21. Because the pile 12 is driven into the ground by providing a downward force to the shaft 19 and turning the pile to screw the inclined plane 21 into the ground rather than providing a high-impact vertical force to the pile, the pile 12 may be made of not only hardened steel or wood, but also of aluminum, aluminum alloys, and similar materials. In a particular embodiment, the piles 12 are hollow tubes that may be reinforced with concrete, steel, or both.

Figure 3:
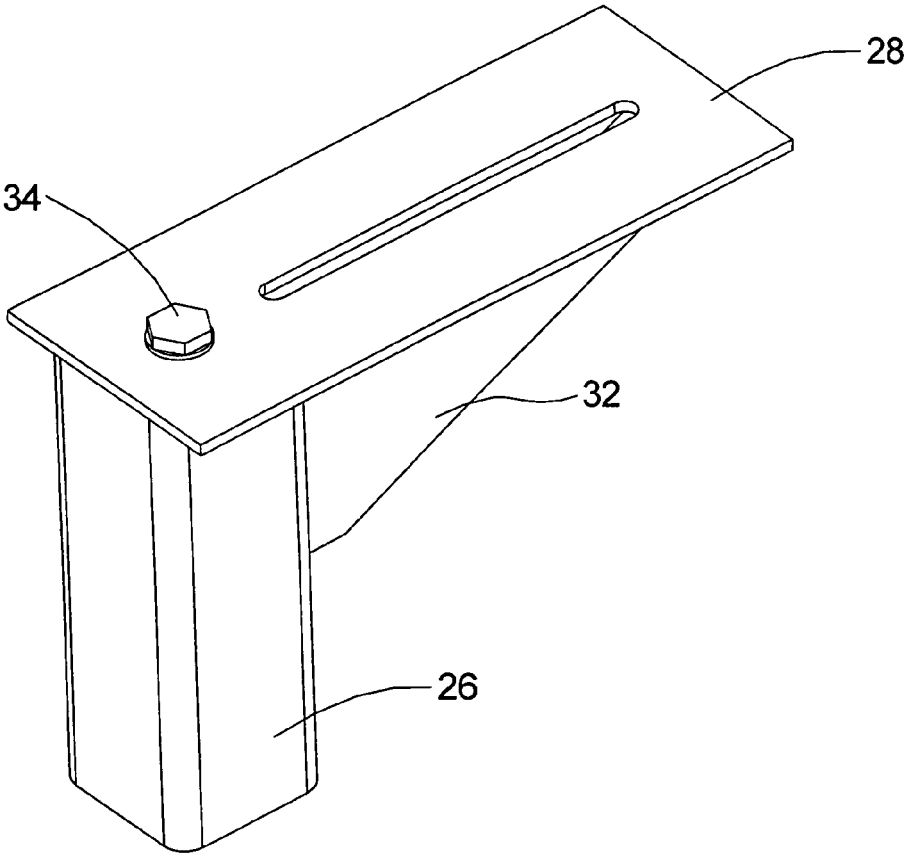
FIG. 3 is an isometric view of an alternative pile bracket.

Though any bracket may be used to connect the pile 12 to the header 14 (or joists 16), the pile bracket 24 of the present embodiment is adjustable by rotation about the axis of the pile 12, elevation relative to the pile 12, distance from the axis of the pile 12, and rotation about an axis offset from the axis of the pile 12. The pile bracket 24 includes a collar 26, a base plate 28, and a saddle assembly 30. The base plate 28 is supported by the collar 26 and supports 32 that are welded or otherwise affixed to the collar 26 and the base plate 28. A fastener 34 engages a tapped hole in the base plate 28 and is substantially aligned with the axis of the collar 26. A disk 36 having a tapped hole for mating with the fastener 34 is welded or otherwise affixed to the top end 22 of the pile 12. When assembled to the pile 12, the collar 26 and base plate 28 may be rotated about the axis of the pile 12. The collar 26 and base plate 28 also may be raised and lowered in relation to the pile 12 by turning the fastener 34. In alternative embodiments, the collar may be other shapes, such as the square collar shown in FIG. 3.

Figure 4B:
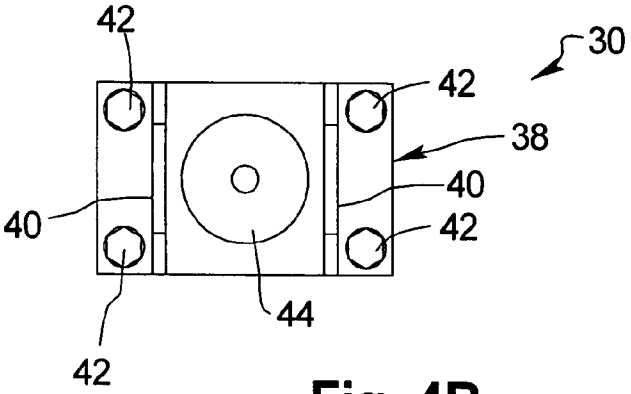
FIGS. 4A-4C are views of the saddle assembly of FIGS. 2A-2D.
Figure 4C:
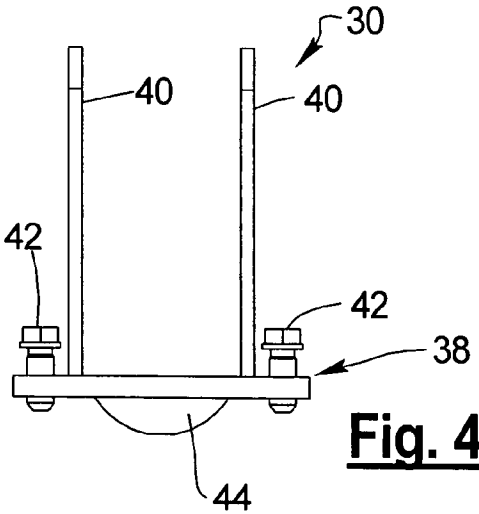
Figure 4A:
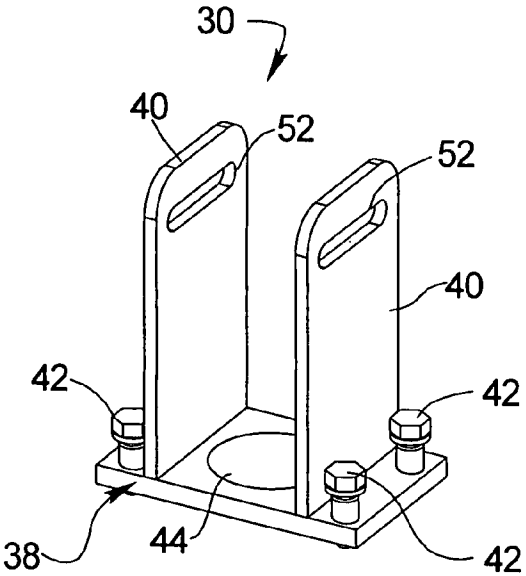
Figure 5D:
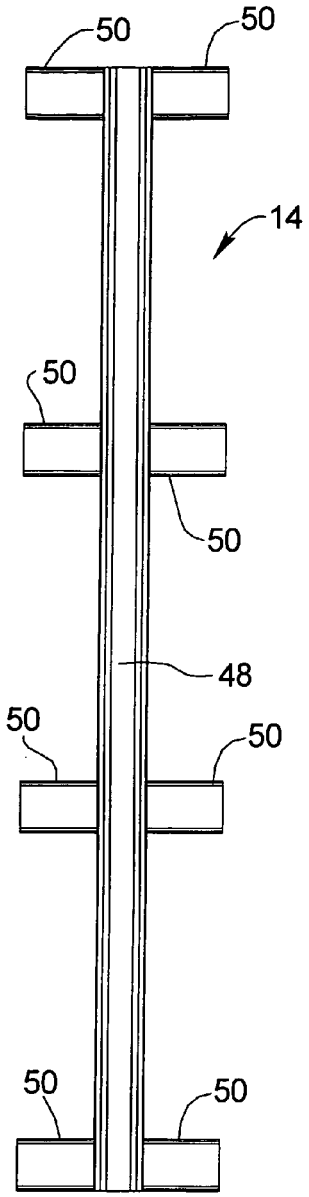
FIGS. 5A-5D are views of a header of FIG. 1.
Figure 5B:
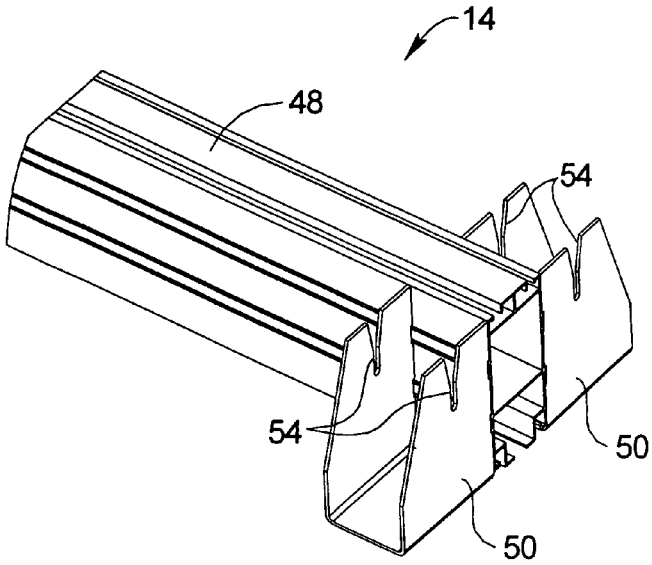
Figure 5A:
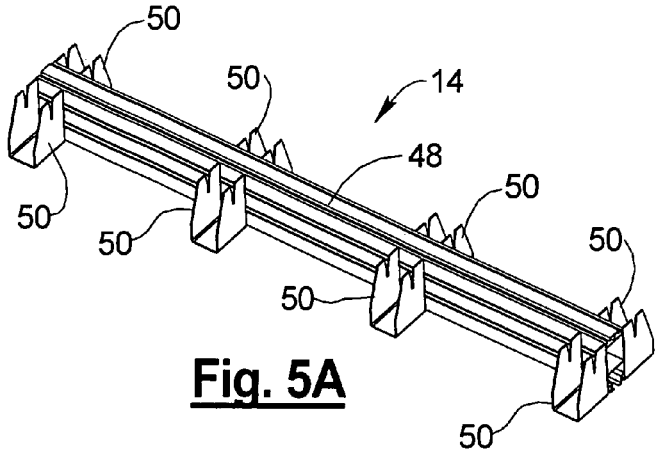
Figure 5C:
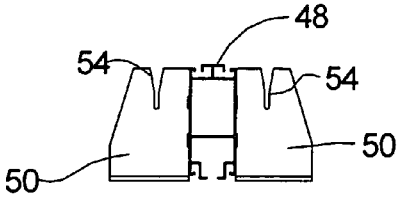

The saddle assembly 30 is best shown in FIGS. 4A-4C and includes a saddle base 38 and vertical plates 40 welded or otherwise affixed to the top of the saddle base 38. Slots 52 in the vertical plates 40 allow the header 14 to be attached to the pile bracket 24 by fasteners. The saddle base 38 includes several set screws 42 and a downward-directed protuberance 44 with a clearance hole for a fastener. The set screws 42 allow fine adjustment of the elevation of the saddle assembly 30 as well as leveling of the saddle assembly 30. A fastener is inserted through the clearance hole in the protuberance 44 and through a slot 46 in the base plate 28, as shown by FIG. 2D. Until the fastener is tightened, the saddle assembly 30 may slide along the slot 46 as well as rotate about the fastener. Thus, the pile bracket 24 is highly adjustable to allow the header 14 to be placed substantially parallel and level with the previously placed header by compensating for variation in the placement of the pile 12. Saddle base 38, shown in detail in FIGS. 4A-4C, is adjustable with six degrees of freedom including controlling its yaw, pitch and roll. The yaw of saddle base 38 is adjustable by rotating the base about its point of attachment to the elongated slot 46. Saddle base 38 has a downward protuberance 44 which has a partially spherical convex shape to facilitate control of the yaw, pitch and roll. The magnitude of the pitch and roll can be controlled by adjusting fasteners 42.

It should be noted that multiple pile extensions may be coupled together with the piles to allow deeper penetration into the ground surface as may be required by the application.

The header 14 is best shown in FIGS. 5A-5D and includes an welded or cast header beam 48 and several joist holders 50. In the illustrated embodiment, the header beam 48 is extruded with grooves on the top and bottom. The end of the header beam 48 is shown as open in the figures to illustrate its shape; however, it is preferred that the end be covered by a cap or a plate after the header beam 48 is cut to length in pre-manufacturing. The header beam 48 is placed between the vertical plates 40 of two or more pile brackets 24 and aligned substantially perpendicular to the intended direction of travel of the deck by adjusting the pile brackets 24. Fasteners inserted through the slots 52 in the vertical plates 40 and a through hole in the header beam 48 to secure the header 14 to the pile bracket 30. The joist holders 50 are welded or cast in place on the header beam 48 to provide a strong support for the joists 16. In alternative embodiments, the joist holders 50 may be fastened in place, such as by rivets, bolts, or screws. The joist holders 50 are aligned such that a joist 16 may be run between two joist holders of two headers 14 and be oriented substantially parallel to the direction of travel of the deck.

In the case that the joist holders 50 are welded onto the header beam 48, they may be cut from a flat piece of material and bent into the U-shape shown in the figures with a bending break or other machine. An angled notch 54 in each side of the joist holder 50 guides a fastener through the end of the joist 16 to provide proper placement of the joist within the joist holder 50. The fastener is tightened to secure the joist 16 to the header 14 and no other fasteners are required, though additional fasteners may be used.

Figure 6A:
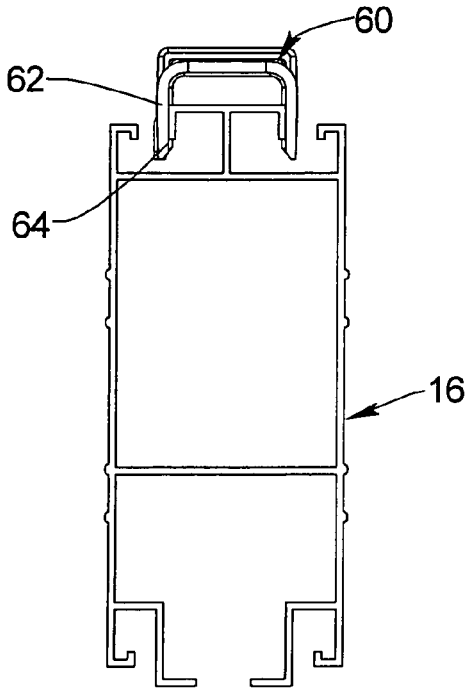
FIGS. 6A and 6B are views of a joist of FIG. 1 with a connector strip attached to the top of the joist in FIG. 6A.
Figure 6B:
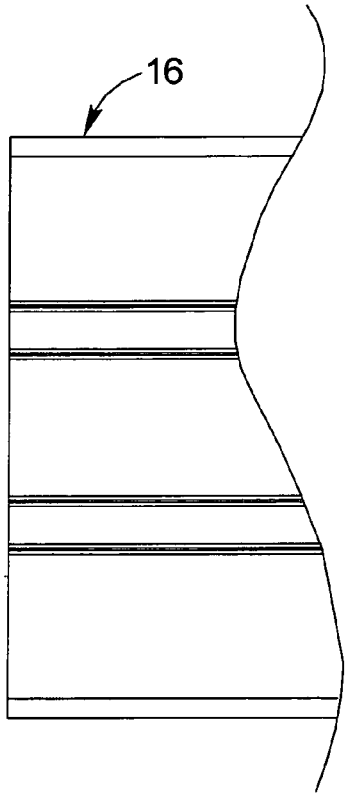
Figures 7A, 7B, 7C, 7D:
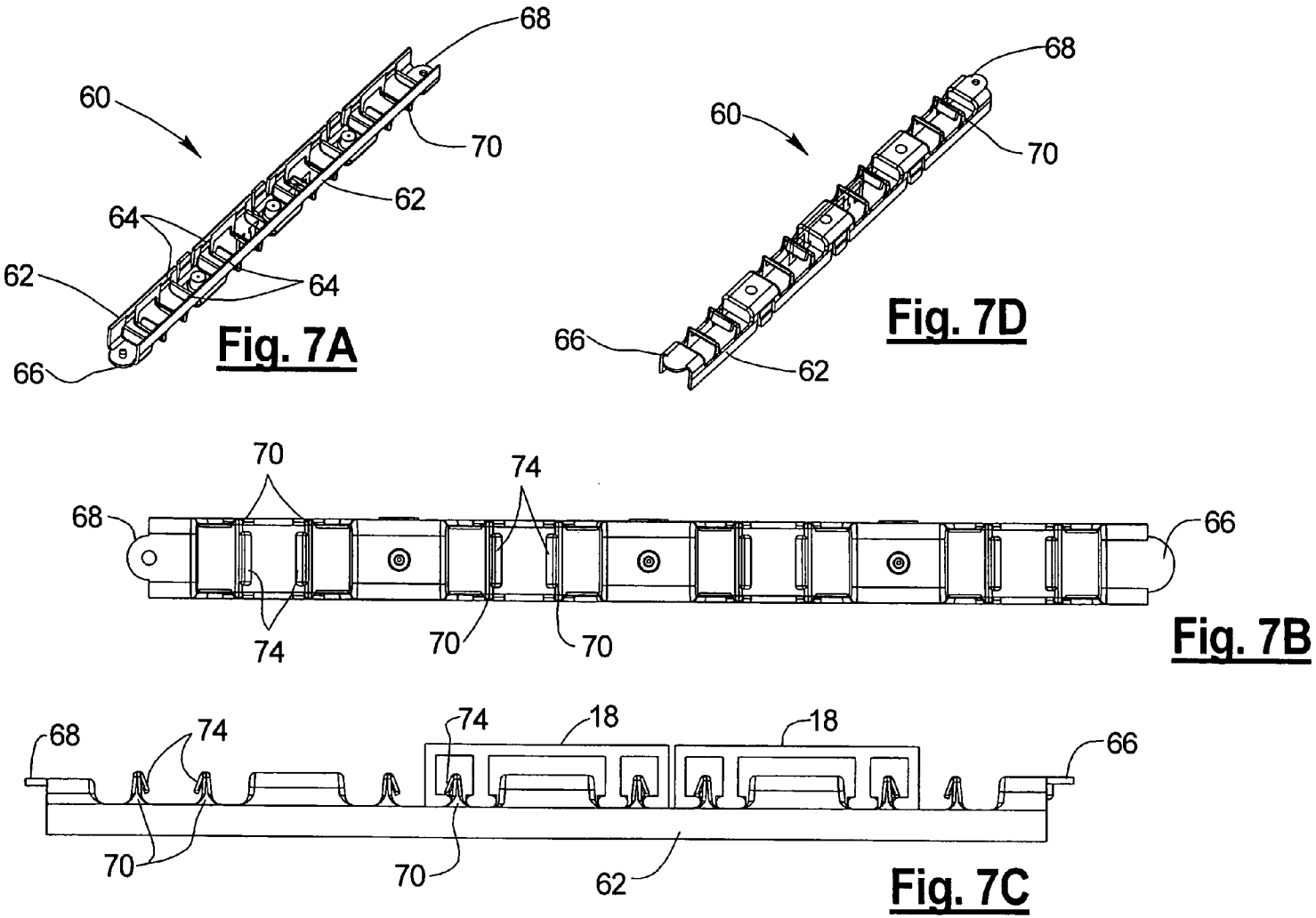
FIGS. 7A-7*d* are views of a connector strip.

The joist 16 is a tubular beam similar to the header beam 48, though the joist 16 may have a different length. The cross-section and the end of the joist 16 are shown in FIGS. 6A and 6B, respectively. The groove features on the top and bottom of the joist 16 provide for snap-connections with cooperating components, such as the connector strip 60, which is described in more detail below. Alternatively, cooperating components slide into the grooves from an end of the joist 16. The outermost joists in the deck module 10 may include railing supports 56 (FIG. 1) that are welded, fastened, or otherwise affixed to the outer side of the joist. These supports 56 may be as simple as boxes for receiving the legs of a railing 58 as shown in FIG. 1.

The deck planks 18 are affixed to the joists 16 via a connector strip 60 shown in FIGS. 7A-7D. The connector strips 60 each have a pair of walls 62 that go into the slots in the top of the joists 16 and include clips 64 that retain the connector strip 60 in connection with the joist 16 (see FIG. 6A). The connector strips 60 may be included on the outermost joists 16 only or on some or all of the inner joists 16. The connector strips 60 may be connected in series along the length of the joist 16 by coupling a male connector end 66 to a female connector end 68.

Figure 8:
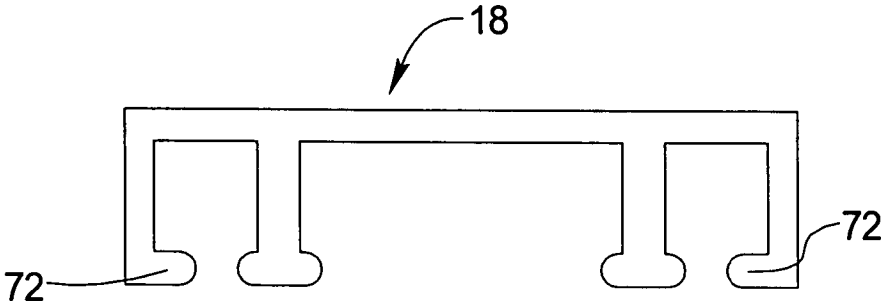
FIG. 8 is an end view of a deck plank of FIG. 1.
Figure 9:
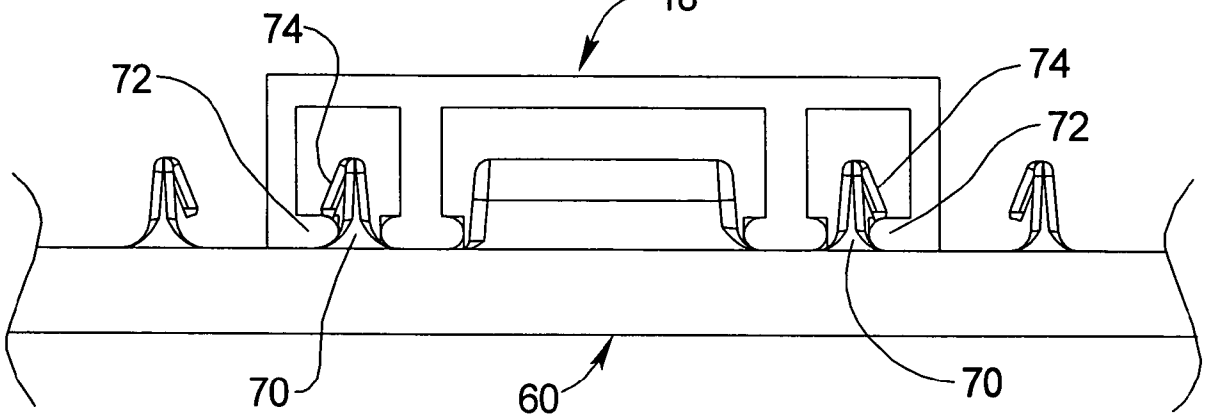
FIG. 9 is a side view of a portion of the connector strip of FIGS. 7A-7D with a deck plank connected thereto.

The connector strips 60 guide the evenly spaced placement of the deck planks 18 along the joists 16 with spacer posts 70. Each connector strip 60 accommodates several deck planks 18. The deck planks 18 may be any substantially rigid material, such as hard plastic, wood, plastic molded with wood, aluminum, or other materials. In one embodiment, the deck planks 18 have a cross-section as shown in FIG. 8, and each includes a pair of tabs 72 configured for mating with clips 74 on the connector strip 60, as shown in FIG. 9. This mating relationship allows the deck planks 18 to be placed without requiring fasteners, though fasteners may be used for further securing the planks. The joint between two connector strips 60 provides space for a deck plank 18 so that the plank may be affixed to the connector strips over the joint. In an alternative embodiment, the deck planks 18 are conventional planks and are fastened to the connector strips 60. In a further alternative embodiment, the deck planks 18 are affixed directly to the joists 16 by fasteners, adhesives, or another suitable method. It should be noted that the connector strips 60 may be configured to be attached to any frame element by a snap-connection, fasteners, or adhesives.

In an alternative embodiment, the connector strips 60 are fastened to conventional lumber and the deck planks 18 may be affixed atop.

Figure 10:
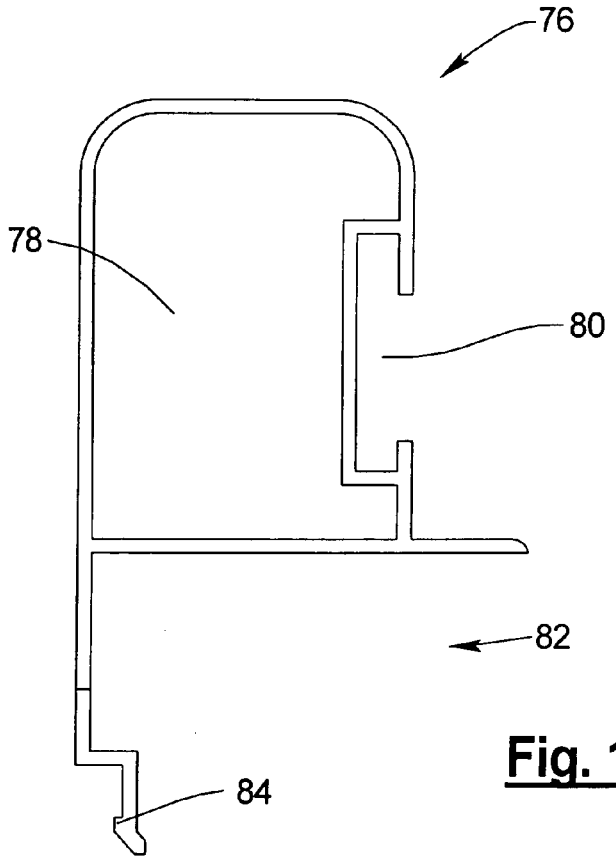
FIG. 10 is an end view of an end cap.

An end cap 76, shown in FIG. 10, may be included running parallel to the joists 16 and covering the ends of the deck planks 18. The end cap 76 may act as a bumper for wheel chairs as required by the Americans with Disabilities Act or for light vehicles. The end cap 76 may also be tubular, as shown in the current embodiment, to provide a chase-way 78 for electrical wiring, water, etc. A lens receiving portion 80 is included on the side of the end cap 76 facing the deck planks 18 so that light from lamps inside the chase-way 78 may be directed onto the top of the planks. The end cap 76 includes a connection portion 82 with a clasp 84 that engages a groove in the top of the outer joists 16.

Figure 11:
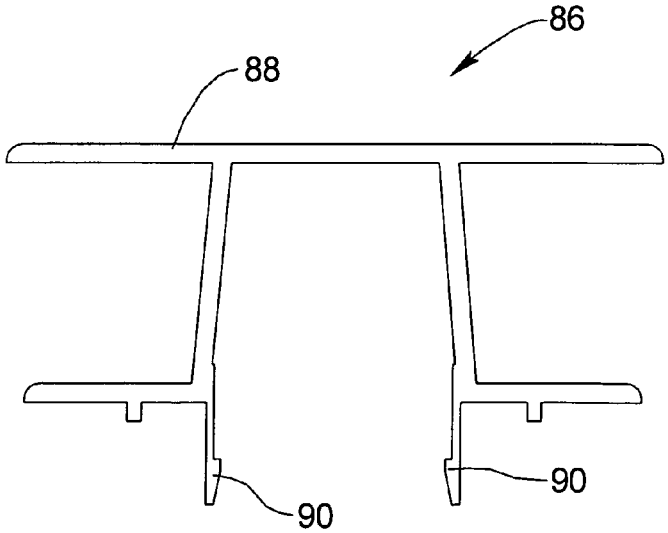
FIG. 11 is an end view of a joining strip.

A joining strip 86, shown in cross-section in FIG. 11, may be included to compensate for elevation changes or turns from one deck module 10 to another. The joining strip 86 includes a top platform 88 that may be angled as required and a pair of tabs 90 that engage grooves in the top of a header 14.

Figure 12:
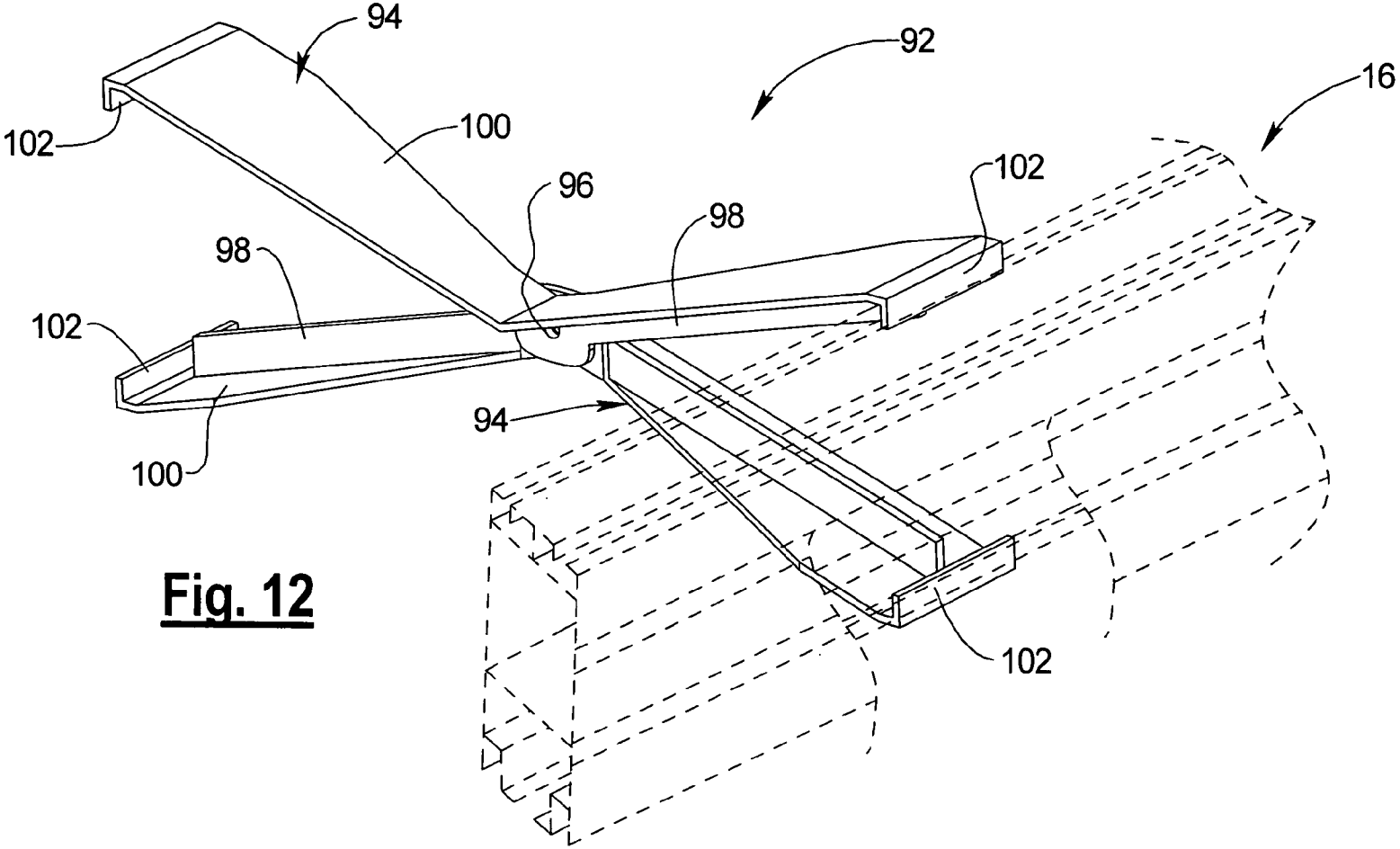
FIG. 12 is an isometric view of a cross-brace assembly.
Figure 13A:
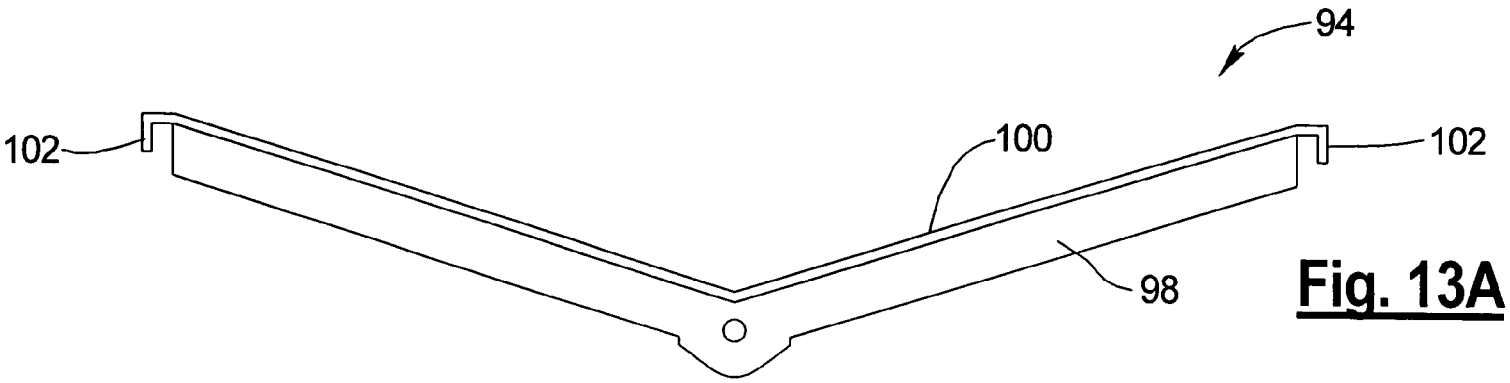
FIGS. 13A and 13B are views of a brace of FIG. 12.
Figure 13B:
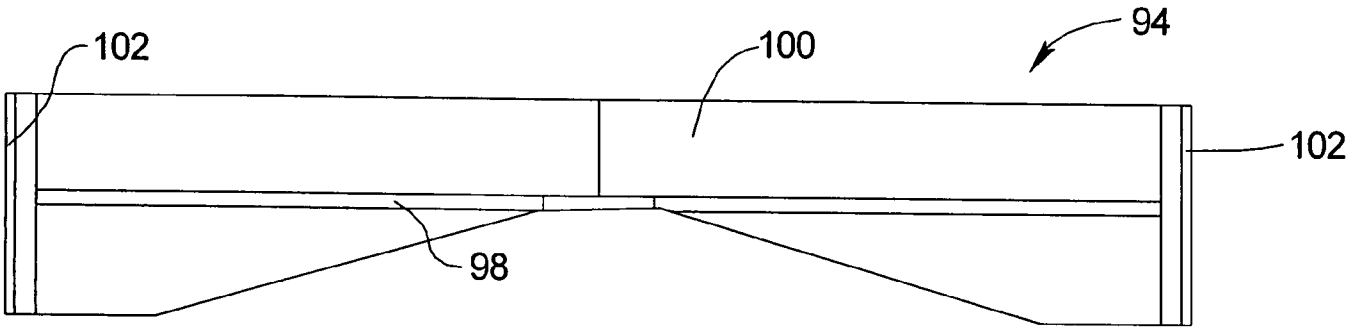

The joists 16 may be reinforced by cross-brace assemblies 92, shown in FIG. 12, having two braces 94 adjoined at a fulcrum 96 by a fastener. Each brace 94 includes a vertical member 98 welded to the bottom surface of a top member 100. The top member 100 includes a protrusion 102 at each end for hooking into a groove in the top or bottom of a joist. The cross-brace assembly 92 is assembled by hooking the protrusions 102 of a first brace 94 into the grooves in the tops of adjacent joists 16. A second, inverted brace 94 is brought up underneath the first brace such that the protrusions 102 of the second brace 94 engage grooves in the bottoms of the adjacent joists 16 and the fulcrum halves meet to form the fulcrum 96. A fastener is inserted into the fulcrum 96 to secure the cross-brace assembly 92. Several cross-brace assemblies installed between each set of adjacent joists 16 will significantly strengthen the deck module 10 without adding substantial weight to the structure.

The structural elements of the deck module 10, such as the piles 12, the headers 14, the joists 16, and the cross-brace assemblies 92, are made of aluminum, aluminum alloy, or a similarly strong, lightweight material according to the present embodiment. Further, these components are generally tubular as shown in the figures, to keep the weight of the components down. Other elements of the module are made of lightweight materials such as lightweight plastics and wood. Therefore the components of the module 10 may be easily transported by a person or a light vehicle.

In use, the modular deck system may be assembled in a variety of locations, such as in a field, in wetlands, or in a body of water, without significantly affecting the location. In an example, the deck system is installed as a dock in a body of water or a boardwalk through wetlands and the deck modules 10 are installed with the personnel and equipment situated on a previously installed deck module. No equipment is required to be submerged or driven though the wetlands to install the modules. Thus, the only impact on the ground surface by the deck system is the driving of the piles 12 into the ground surface. However, as the application warrants and allows, the system may also be installed at ground level.

The deck module 10 is assembled by driving a first set of piles 12 and a second set of piles 12 into a ground surface. In the current embodiment, each set of piles includes two piles 12; however, additional piles 12 may be used to further support the headers 14, the joists 16, or both. The helical piles 12 are installed by applying vertical force and rotating the pile 12 to screw it into the ground or wetland floor. A pile bracket 24 is assembled onto the top of each pile 12 and adjusted so that the saddle assembly 30 is level and the headers 14 may be aligned substantially parallel to each other. One header 14 is fastened to the saddle assemblies 30 of the first set of piles 12 and the second header 14 is fastened to the saddle assemblies 30 of the second set of piles 12. The pile brackets 24 are finely adjusted such that the headers 14 are level and aligned and the joist holders 50 of one header 14 are each aligned with a joist holder 50 of the opposite header 14. A bolt or other fastener is inserted through a hole near each end of each joist 16 such that the bolt extends through both sides of the joist. Each joist is then placed into two aligned joist holders 50 with the bolts engaging the notches 54. The bolts are mated with nuts and tightened to secure the joist 16. Four joists 16 are used in the illustrated embodiment, though more or less may be required in specific applications. Several of the cross-brace assemblies 92 are assembled between each pair of adjacent joists 16 as needed.

The walls 62 of the connector strips 60 are inserted into grooves in the tops two or more of the joists 16 and connected in series by the connector ends 66, 68. The connector strips 60 may be secured to the joists 16 by fasteners. The deck planks 18 are placed between the spacer posts 70 and connected to the connector strips 60 by a snap connection, fasteners, or both. The end caps 76 are connected to the outermost joists 16 and over the edges of the deck planks 18. The railings 58 may then be inserted into the railing supports 56.

A subsequent module is assembled from the first module by driving a third set of piles 12 into the ground surface relatively aligned with the first and second sets of piles 12. Imprecise placement of the piles 12 is compensated by the adjustable pile brackets 24. A third header 14 is attached to the pile brackets 24 of the third set of piles and the brackets are adjusted such that the header is level and aligned with the second header 14. Several joists 16 are placed into the joist holders 50 of the second and third headers 14. The remaining components are assembled as described with the first module 10 above. Additional modules are likewise added as required. Because interlocking, preformed components are used in the construction of the deck module 10 and few fasteners are required, disassembly of the deck module 10 is made simple.

In an alternative embodiment, the components of the deck module are made of a stronger, heavier materials, such as steel. The system retains its advantages of rapid installation and strong joints, though heavier equipment may be required to transport the heavier materials. This alternative embodiment would be useful, for example, for a temporary, high-strength bridge for heavy equipment in a military setting.

It should be particularly noted that certain deck modules 10 may have angled planks and curved joists for turning corners. In this case, the headers 14 are aligned such that the curved joists may be placed in the joist holders 50. Further, the headers 14 may be aligned for gradual changes in elevation. In this case, the joist holders 50 may be slanted to accommodate the angled joists 16.

It should be further noted that several of the components of the deck module 10 of the present invention may be used separate from the other components of the module. The header 14 with the integral or welded-on joist holders 50 may be used to support conventional wooden joists or the header may be supported by structural elements other than piles. The connector strip 60 may be configured to engage dimensional lumber or other materials instead of the extruded joists 16. The pile bracket 24 may be used in any application that may benefit from a wide range saddle bracket. The aluminum helical piles 12 may be used in any situation requiring a lightweight or corrosive resistant pile.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

The invention claimed is:

1. A modular decking system, comprising:

a plurality of piles having a helical portion configured to be driven into a ground surface;

a plurality of headers;

a plurality of joists each being attached to two of said headers; and a plurality of deck planks being attached to a top portion of said joists;

a plurality of adjustable assemblies each providing six degrees of freedom of movement and engaging a top end of a corresponding pile of the plurality of piles, each assembly including a saddle base that supports at least one of the headers, the saddle base slideably engaging an elongated slot of a baseplate that is rotatable about the center axis of the pile and translatable along the center axis of the pile, thereby providing three degrees of freedom;

wherein the saddle base of each assembly further includes at least two adjustable fasteners that are aligned above the baseplate such that independent adjustment of the fasteners allows control of the pitch and roll of the saddle base relative to the baseplate, thereby providing a fourth and fifth degree of freedom;

wherein the saddle base is rotatable about a point of attachment to the elongated slot such that the saddle base has its yaw controlled by the rotation about the point, thereby providing a sixth degree of freedom.

2. The decking system of claim 1, the elongated slot in said baseplate, the elongated slot extending substantially perpendicular to the center axis of said pile.

3. The decking system of claim 1, said deck planks being attached to said joists by a molded connector strip.

4. The decking system of claim 3, said connector strip having a plurality of spacer posts separating said deck planks.

5. The decking system of claim 3, said connector strip having a plurality of clips provided in pairs, said deck planks each comprise a pair of tabs, and wherein each pair of clips is configured for mating with the pair of tabs on one of said deck planks.

6. The decking system of claim 3, said connector strips being connectable in series.

7. The decking system of claim 1, said header comprising a plurality of joist holders, wherein said joists are placed in said joist holders to attach said joists to said headers.

8. The decking system of claim 7, wherein said joist holders define a pair of aligned notches that engage a fastener through an end of said joist to guide the placement of said joist.

9. The decking system of claim 7, wherein said joist holders are welded to said header.

10. The decking system of claim 7, wherein said joist holders are cast in place.

11. The decking system of claim 1, said piles comprising aluminum.

12. The decking system of claim 1, further comprising an end cap attached to an outermost joist and covering an edge of said deck planks.

13. The decking system of claim 12, said end cap providing a wheel chair bumper.

14. The decking system of claim 12, said end cap comprising a chase-way and a lamp.

15. The decking system of claim 1, further comprising a plurality of cross-braces connecting each of said joists to an adjacent joist.

16. The decking system of claim 1, further comprising a railing engaging supports attached to an outermost joist.

17. A modular decking system, comprising:

a plurality of piles having a helical portion configured to be driven into a ground surface;

a plurality of headers;

a plurality of joists each being attached to two of said headers;

a plurality of deck planks being attached to a top portion of said joists; and a plurality of adjustable assemblies each providing six degrees of freedom of movement and engaging a top end of a corresponding pile, each assembly including a saddle base that supports at least one of the headers, the saddle base having a partially spherical convex protuberance that slideably engages an elongated slot of a baseplate that is rotatable about the center axis of the pile and translatable along the center axis of the pile, thereby providing three degrees of freedom;

wherein the saddle base of each assembly further includes adjustable fasteners that are aligned above the baseplate such that independent adjustment of the fasteners allows control of the pitch and roll of the saddle base relative to the baseplate, thereby providing a fourth and fifth degree of freedom;

wherein the saddle base is rotatable about a point of attachment to the elongated slot such that the saddle base has its yaw controlled by the rotation about the point, thereby providing a sixth degree of freedom.

18. The decking system of claim 17, wherein the point of attachment of the saddle base to the elongated slot is in the center of the partially spherical convex protuberance.

19. The decking system of claim 17, wherein there are at least three adjustable fasteners.

20. A modular decking system, comprising:

a plurality of piles having a helical portion configured to be driven into a ground surface;

a plurality of headers;

a plurality of joists each being attached to two of said headers;

a plurality of deck planks being attached to a top portion of said joists;

a plurality of adjustable assemblies, each of which supports at least one of the headers or at least one of the joists, each assembly engaging a top end of a corresponding pile of the plurality of piles, wherein the adjustable assemblies include means for adjusting the assembly with six degrees of freedom.

21. A modular decking system, comprising:

a plurality of piles having a helical portion configured to be driven into a ground surface;

a plurality of headers;

a plurality of joists each being attached to two of said headers;

a plurality of deck planks being attached to a top portion of said joists;

a plurality of adjustable assemblies, each of which supports at least one of the headers or at least one of the joists, each assembly engaging a top end of a corresponding pile of the plurality of piles, wherein the adjustable assemblies each include a saddle base, the assemblies each having means for adjusting the saddle base with six degrees of freedom including the yaw, roll and pitch of the saddle base.

22. The decking system of claim 21, wherein the means for adjusting pitch, yaw and roll of the saddle base includes at least three adjustable fasteners disposed in the saddle base.

23. The decking system of claim 21, wherein the means for adjusting pitch, yaw and roll of the saddle base includes four adjustable fasteners disposed in the saddle base.

24. The decking system of claim 21, wherein the adjustable assemblies each include a baseplate with an elongated slot that slideably engages the saddle base, wherein the means for adjusting with six degrees of freedom includes means for rotating the baseplate about the center axis of its corresponding pile.

25. The decking system of claim 24, wherein the means for adjusting with six degrees of freedom includes means for translating the baseplate along the center axis of its corresponding pile.

26. The decking system of claim 21, wherein the adjustable assemblies each include a baseplate with an elongated slot that slideably engages a partially spherical convex protuberance of the saddle base, wherein the means for adjusting with six degrees of freedom includes means for rotating the baseplate about the center axis of its corresponding pile.

* * * * *